US008439708B2

(12) United States Patent
Colantuono et al.

(10) Patent No.: US 8,439,708 B2
(45) Date of Patent: May 14, 2013

(54) ELECTRICAL CONNECTOR WITH CANTILEVERED ARM INTEGRALLY FORMED ON METAL SHELL

(75) Inventors: Robert Colantuono, Dover, PA (US); Terrance F. Little, York, PA (US); Yi-Guo Qi, Shenzhen (CN); Hung-Yang Yeh, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 65 days.

(21) Appl. No.: 13/073,970

(22) Filed: Mar. 28, 2011

(65) Prior Publication Data

US 2012/0252255 A1 Oct. 4, 2012

(51) Int. Cl.
*H01R 24/00* (2006.01)

(52) U.S. Cl.
USPC ..... 439/660; 439/607.41

(58) Field of Classification Search ..... 439/79, 439/352–358, 607.41, 660
See application file for complete search history.

(56) References Cited

U.S. PATENT DOCUMENTS

| | | | | |
|---|---|---|---|---|
| 5,660,558 | A | 8/1997 | Osanai et al. | |
| 6,139,350 | A * | 10/2000 | Mathesius | 439/357 |
| 6,358,088 | B1 | 3/2002 | Nishio et al. | |
| 6,902,432 | B2 * | 6/2005 | Morikawa et al. | 439/607.41 |
| 7,549,896 | B2 * | 6/2009 | Zhang et al. | 439/607.01 |
| 7,824,222 | B2 | 11/2010 | Miyoshi et al. | |
| 8,033,853 | B2 * | 10/2011 | Chang | 439/304 |
| 8,083,535 | B2 * | 12/2011 | Chang | 439/357 |
| 8,152,566 | B1 * | 4/2012 | Little et al. | 439/607.41 |

* cited by examiner

*Primary Examiner* — Thanh Tam Le
(74) *Attorney, Agent, or Firm* — Ming Chieh Chang; Wei Te Chung

(57) ABSTRACT

An electrical connector includes an insulative housing, a number of contacts retained in the insulative housing and a metal shell enclosing the insulative housing. The metal shell includes a top wall defining a pair of slits each extending along a transverse direction, a cutout communicating with the slits and a L-shaped cantilevered arm residing in the slits and the cutout. The cantilevered arm includes a base portion protruding along the transverse direction and situated between the pair of slits and a deformable arm extending into the cutout along a mating direction perpendicular to the transverse direction. The deformable arm comprises a locking protrusion bent upwardly for locking with a notch of a mateable connector.

12 Claims, 18 Drawing Sheets

ELECTRICAL CONNECTOR WITH CANTILEVERED ARM INTEGRALLY FORMED ON METAL SHELL

BACKGROUND OF THE INVENTION

1. Field of the Invention

The present invention relates to an electrical connector, and more particularly to an electrical connector with improved cantilevered arms integrally formed on a metal shell for locking with a mateable connector. The instant application relates to U.S. applications titled "ELECTRICAL CONNECTOR WITH RESILIENT ARM CONFIGURED IN SIMPLE SUPPORTED BEAM MANNER FORMED ON METAL SHELL", filed Feb. 16, 2011, application Ser. No. 13/028247, and "ELECTRICAL CONNECTOR WITH IMPROVED LOCKING PROTRUSION INTEGRALLY FORMED ON METAL SHELL", filed Feb. 23, 2011, application Ser. No. 13/032708, respectively, and having the same assignee therewith.

2. Description of Related Art

Micro-USB connectors, including receptacle connectors and plug connectors, are usually used as a standard power charging port or a standard data transmission port in mobile devices. U.S. Pat. No. 7,824,222 B2 issued to Miyoshi et al. on Nov. 2, 2010 discloses such an electrical plug connector including an insulative housing, a plurality of contacts fixed on the insulative housing, a pair of locking members retained on the insulative housing and located at lateral sides of the contacts, and top and bottom metal covers jointly enclosing the insulative housing. The insulative housing defines a pair of slots for accommodating movement of the locking members. Each locking member includes a retaining portion fixed in the insulative housing, a cantilevered beam extending forwardly from the retaining portion, and a hook formed on the distal end of the cantilevered beam. Each hook extends upwardly through a cutout of the top metal cover for locking with a complementary metal shell of a receptacle connector. However, since the locking members are separately made, an additional assembly process for mounting the locking member to the insulative housing is required, which will increase the costs of the plug connector.

U.S. Pat. No. 5,660,558 issued to Osanai et al. on Aug. 26, 1997 discloses an electrical connector including an insulative housing and top and bottom metal shells attached to the insulative housing along opposite directions. The top metal shell includes a base and a pair of forked cantilevered arms extending forwardly beyond a front surface of the base. Each cantilevered arm is elongate and includes a hook located at a distal end thereof for mating with a mateable connector. Besides, in order to accommodate the cantilevered arms, a pair of slits are needed to be formed on the insulative housing, which might restrict contact arrangement. With the trend that the transmission speed of connectors becomes more and more faster, the contact density in the connectors is getting higher. Under this situation, there will be no extra space on the insulative housing for mounting the locking members.

Hence, an electrical connector having improved locking protrusions integrally formed on a metal shell is desired.

BRIEF SUMMARY OF THE INVENTION

The present invention provides an electrical connector including an insulative housing, a plurality of contacts retained in the insulative housing and a metal shell enclosing the insulative housing. The metal shell includes a top wall, a bottom wall, and a pair of side walls connecting the top wall and the bottom wall to jointly form a receiving space to accommodate the insulative housing. The top wall includes a pair of slits each extending along a transverse direction, a cutout communicating with the slits and a L-shaped cantilevered arm residing in the slits and the cutout. The cantilevered arm includes a base portion protruding along the transverse direction and situated between the pair of slits and a deformable arm extending into the cutout along a mating direction perpendicular to the transverse direction. The deformable arm comprises a locking protrusion bent upwardly for locking with a notch of a mateable connector. The base portion has a length measured along the mating direction which is larger than a width of the locking protrusion measured along the transverse direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
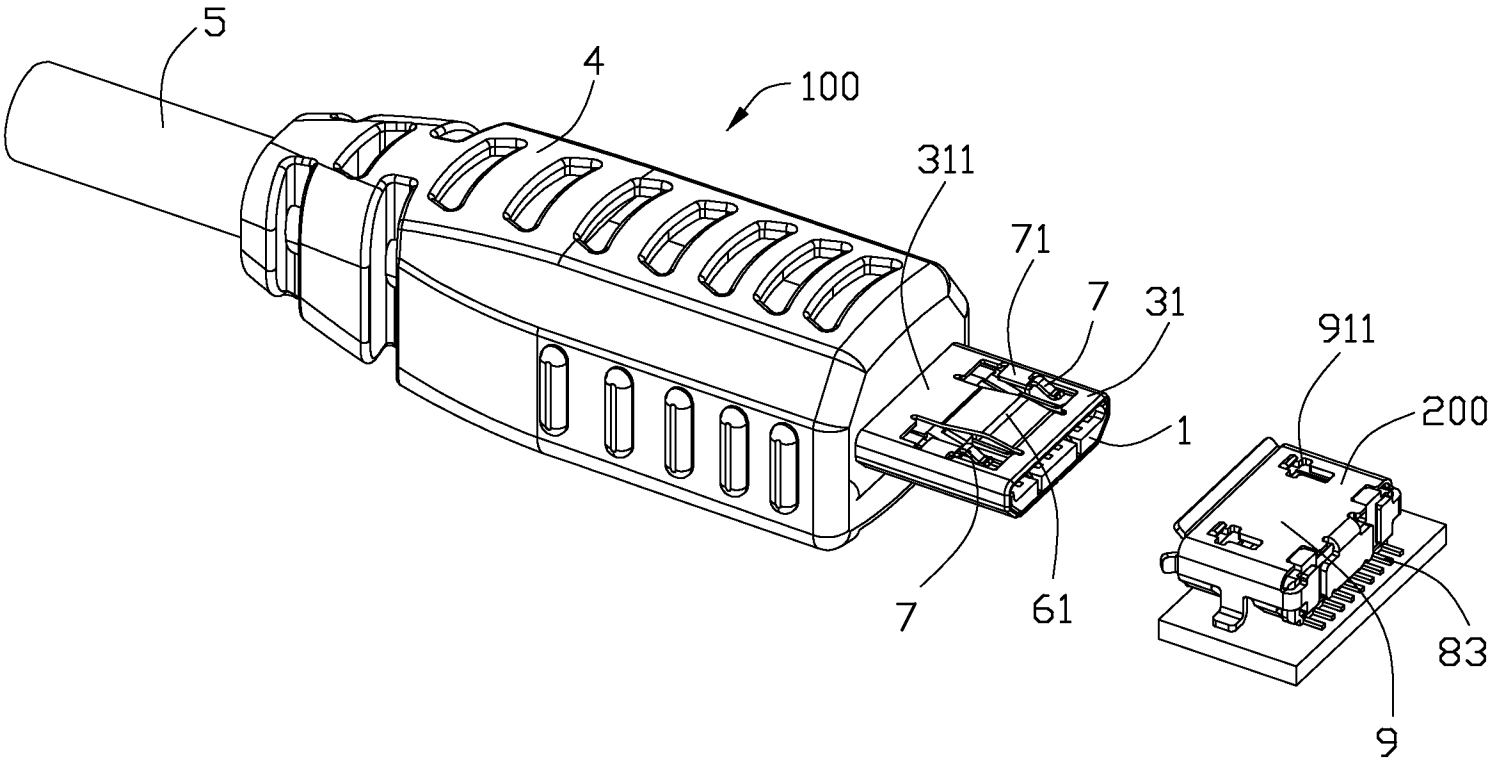
FIG. 1 is a perspective view of a connector assembly including a receptacle connector and a plug connector prior to be inserted into the receptacle connector in accordance with a first embodiment of the present invention.
Figure 2:
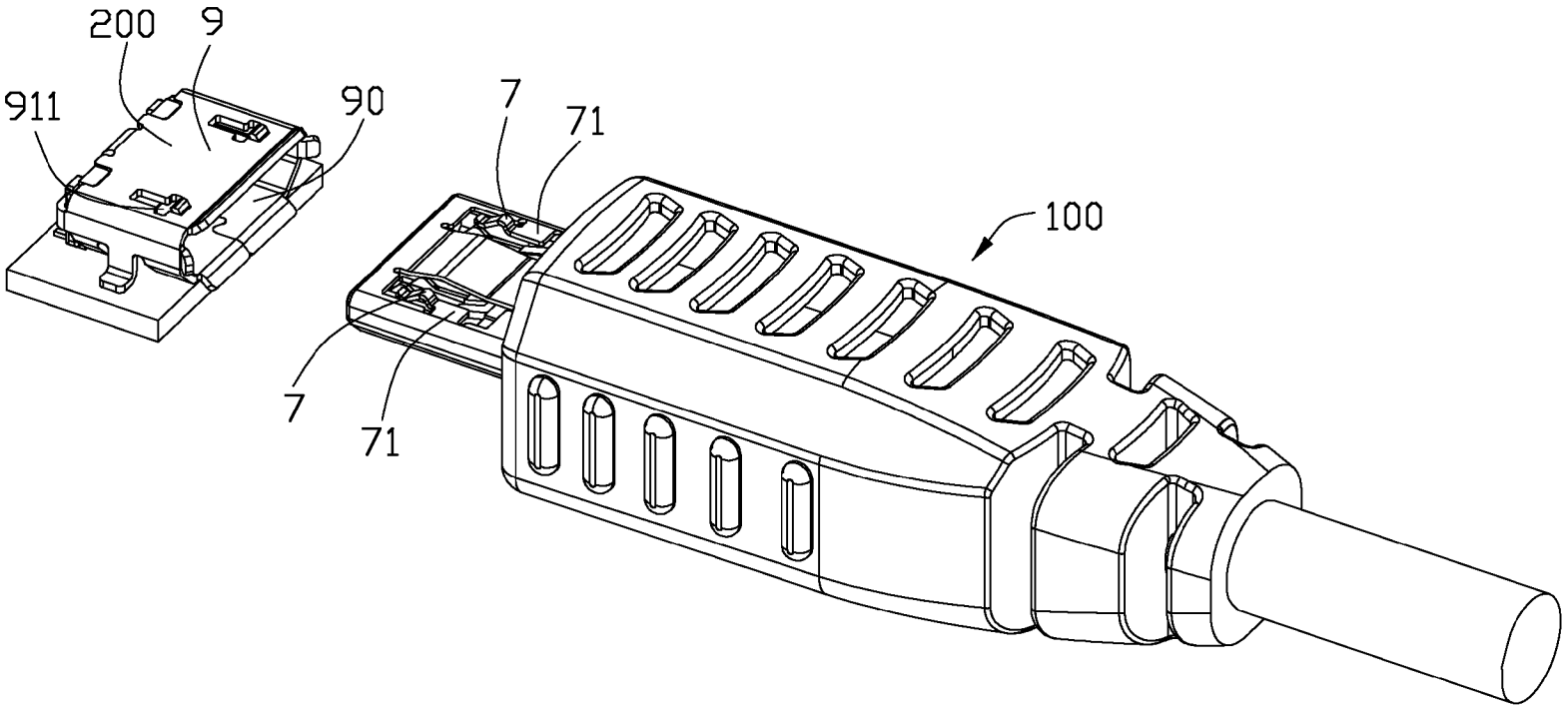
FIG. 2 is a perspective view of the connector assembly as shown in FIG. 1, taken from another aspect.
Figure 9:
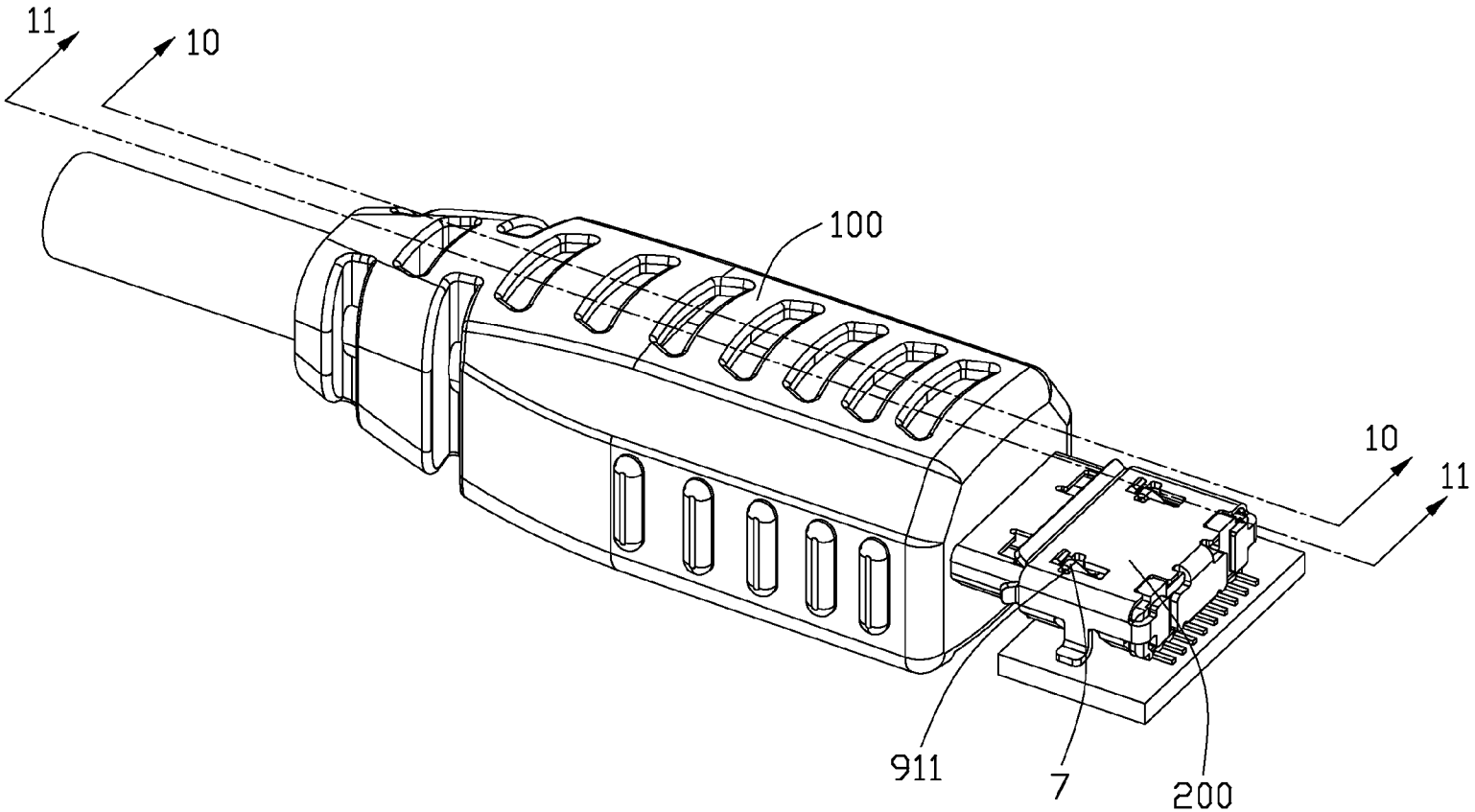
FIG. 9 is a perspective view of the connector assembly with the plug connector inserted into the receptacle connector.

Reference will now be made to the drawing figures to describe the preferred embodiment of the present invention in detail. FIGS. 1, 2 and 9 illustrate a connector assembly including a plug connector 100 and a receptacle connector 200 which is mounted on a PCB for mating with the plug connector 100. According to the illustrated embodiment of the present invention, the plug connector 100 and the receptacle connector 200 are compatible to Micro USB specification revision 1.01 released by USB-IF.

Figure 3:
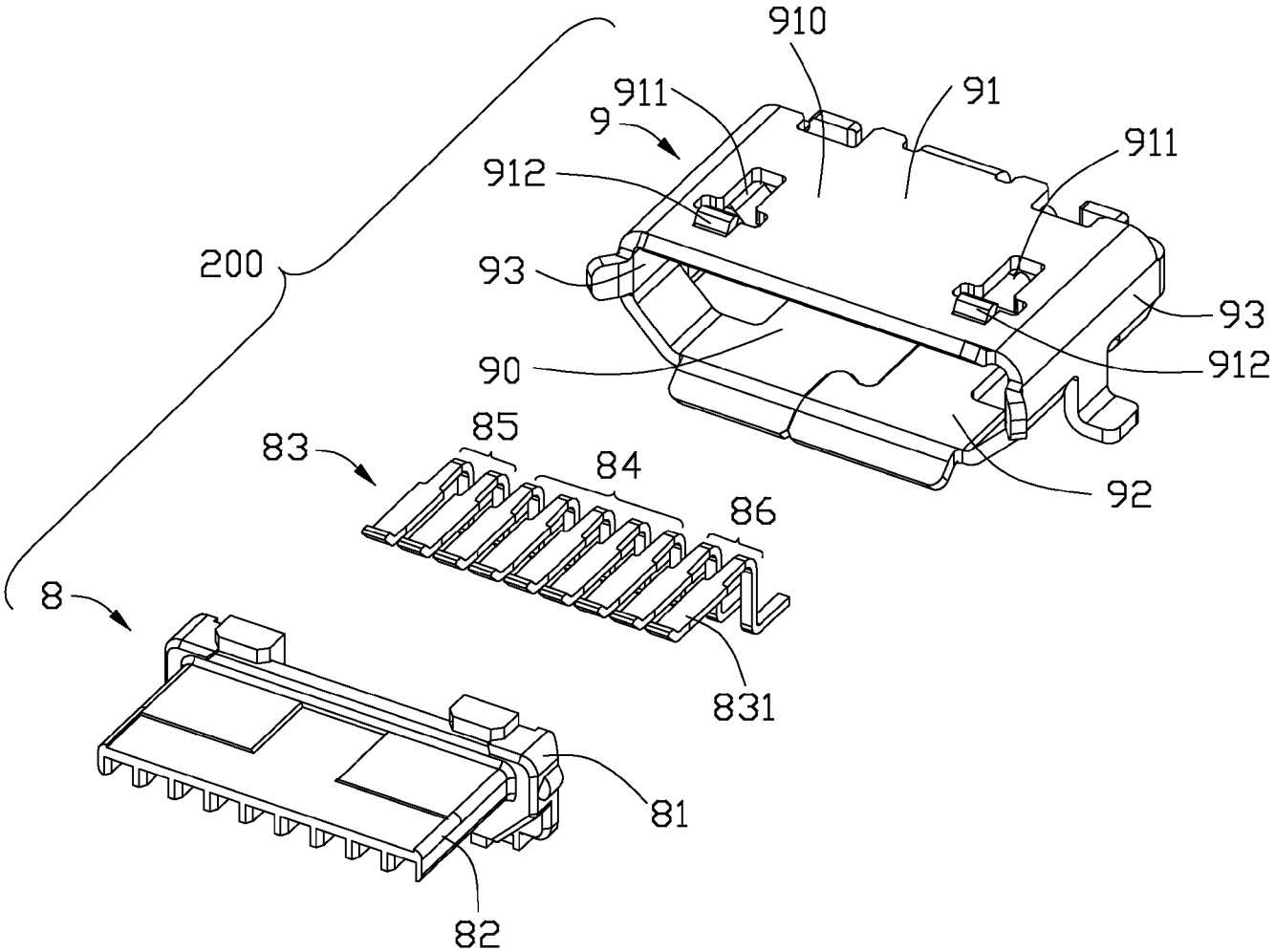
FIG. 3 is an exploded view of the receptacle connector.

Referring to FIG. 3, the receptacle connector 200 includes a receptacle housing 8 and a metal shield 9 enclosing the receptacle housing 8. The receptacle housing 8 includes a base 81 and a tongue plate 82 extending from the base 81. The metal shield 9 includes a top wall 91, a bottom wall 92 and a pair of side walls 93 which are jointly with the top wall 91 and the bottom wall 92 to define a plug-receiving cavity 90 enclosing the tongue plate 82. The top wall 91 defines a pair of T-shaped notches 911 communicating with the plug-receiving cavity 90 and a pair of reinforce blocks 912 at one end of the corresponding notches 911. Each reinforce block 912 is stamped from the top wall 91 to extend beyond a top surface 910 of the top wall 91. Besides, a plurality of receptacle contacts 83 are mounted on the tongue plate 82 and include five receptacle-type contacts 84 compatible to Micro-USB specification revision 1.01 and two pairs of additional contacts 85, 86 located at lateral sides of the receptacle-type contacts 84. Each receptacle contact 83 includes a flat contacting portion 831 exposed to the plug-receiving cavity 90.

Figure 4:
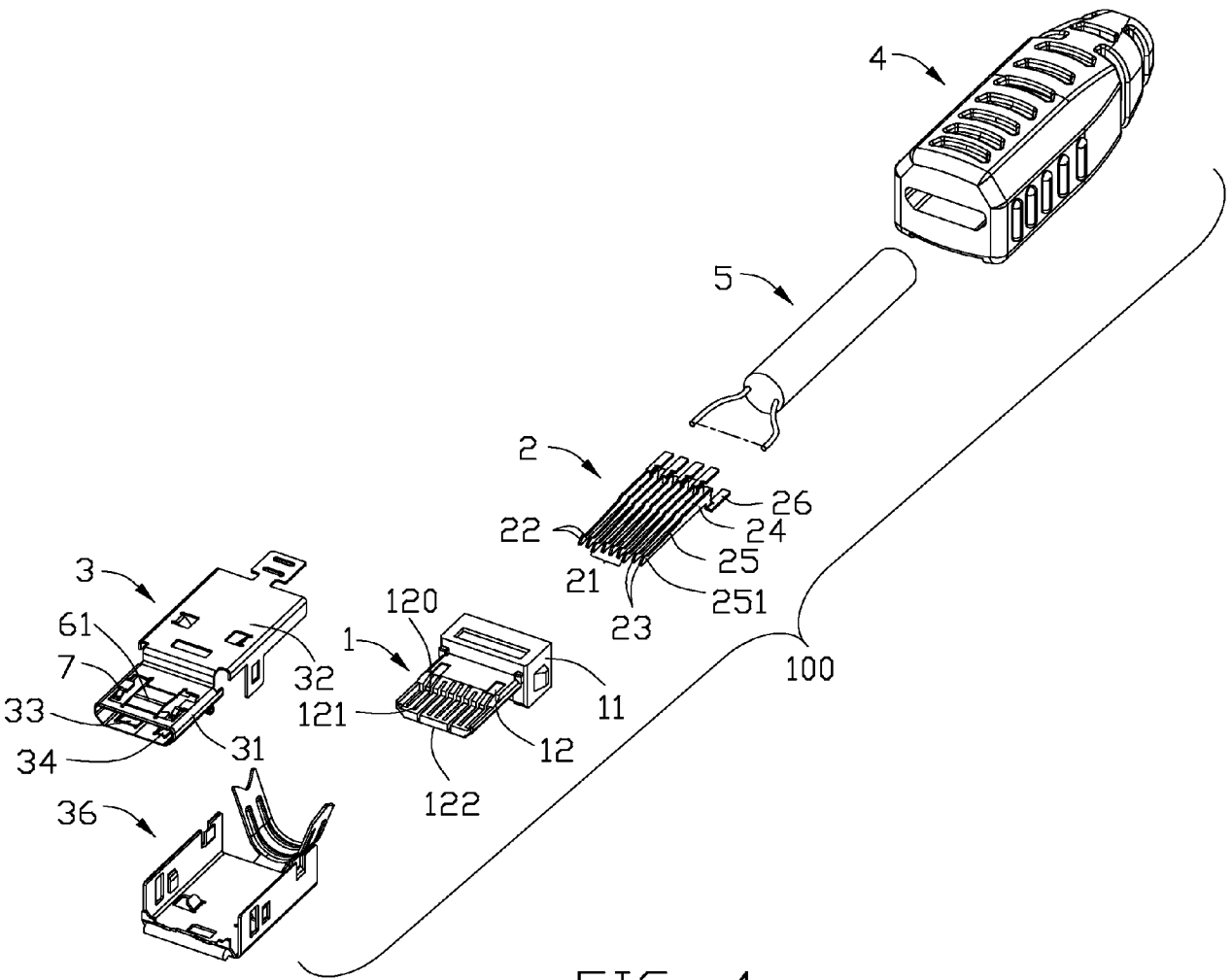
FIG. 4 is an exploded view of the plug connector.

Referring to FIG. 4, the plug connector 100 includes an insulative housing 1, a plurality of contacts 2 retained in the insulative housing 1, a metal shell 3 enclosing part of the insulative housing 1, a bottom shell 36 attached to the metal shell 3, an outer housing 4 over-molding the metal shell 3 and the bottom shell 36, and a plurality of cables 5 electrically connected with the corresponding contacts 2.

The insulative housing 1 includes a rear base portion 11 and a tongue portion 12 extending forwardly from the base portion 11. The tongue portion 12 includes a mating surface 121, a bottom surface 122 opposite to the mating surface 121 and a plurality of contact-receiving slots 120 recessed from the mating surface 121. The contact-receiving slots 120 further extend through the base portion 11 for receiving the contacts 2 along a rear-to-front direction.

Figure 10:
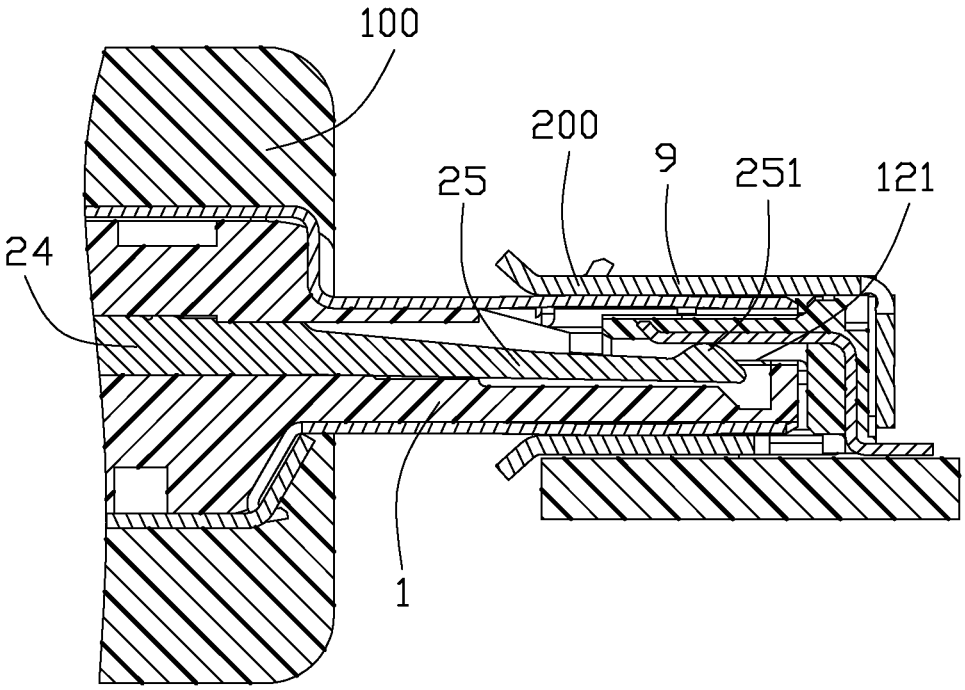
FIG. 10 is a cross-sectional view of the connector assembly taken along line 10-10 in FIG. 9 showing receptacle contacts and plug contacts mateable with each other.

The contacts 2 include five plug-type contacts 21 compatible to Micro-USB specification revision 1.01 and two pairs of additional contacts 22, 23 located at lateral sides of the plug-type contacts 21. The additional contacts 22, 23 occupy the remainder space of the tongue portion 12 besides the plug-type contacts 21 with respect to conventional Micro USB plugs as described in the background of the instant invention. With arrangement of the additional contacts 22, 23, transmission speed of the plug connector 100 is greatly improved. Each contact 2 includes a fixing portion 24 fixed to the base portion 11 of the insulative housing 1, a cable end portion 26 extending backwardly from the fixing portion 24 for being electrically connected the cables 5, and an elastic arm 25 extending forwardly from the fixing portion 24. The elastic arm 25 is cantilevered and includes a tapered contacting section 251 (as also shown in FIG. 10) formed at the distal end thereof. The contacting section 251 protrudes beyond the mating surface 121 of the tongue portion 12. The elastic arm 25 is deformable in the corresponding contact-receiving slot 120 when the plug connector 100 is inserted into the receptacle connector 200.

Figure 5:
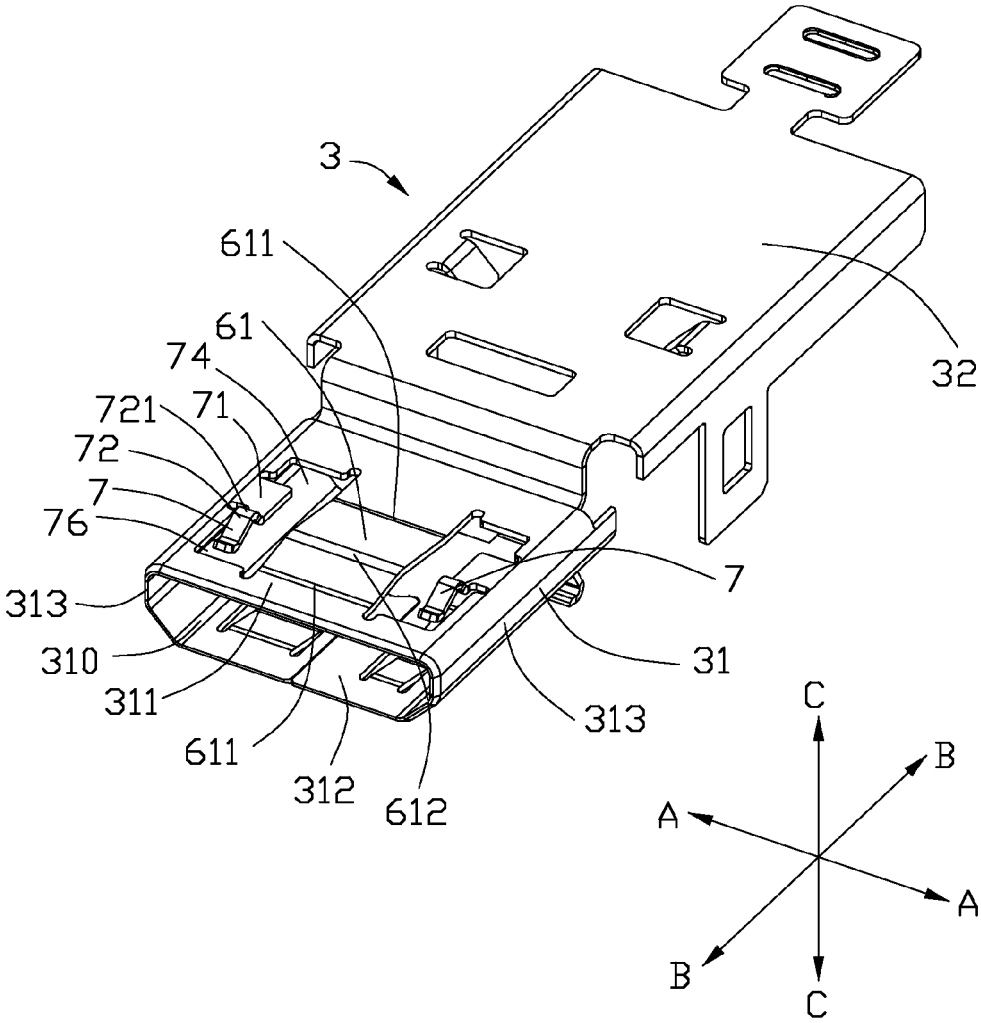
FIG. 5 is a perspective view of a metal shell of the plug connector.
Figure 6:
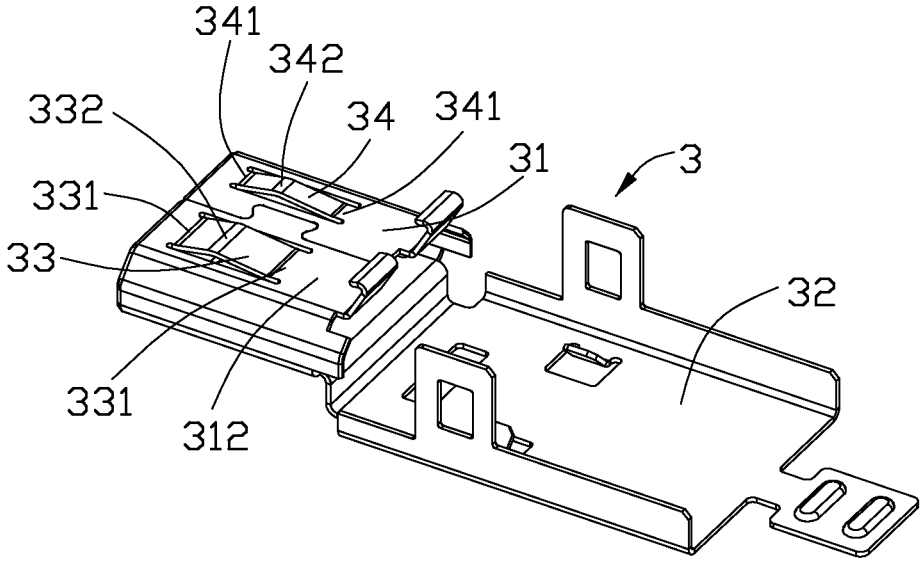
FIG. 6 is another perspective view of the metal shell as shown in FIG. 5, taken from another aspect.
Figure 7:
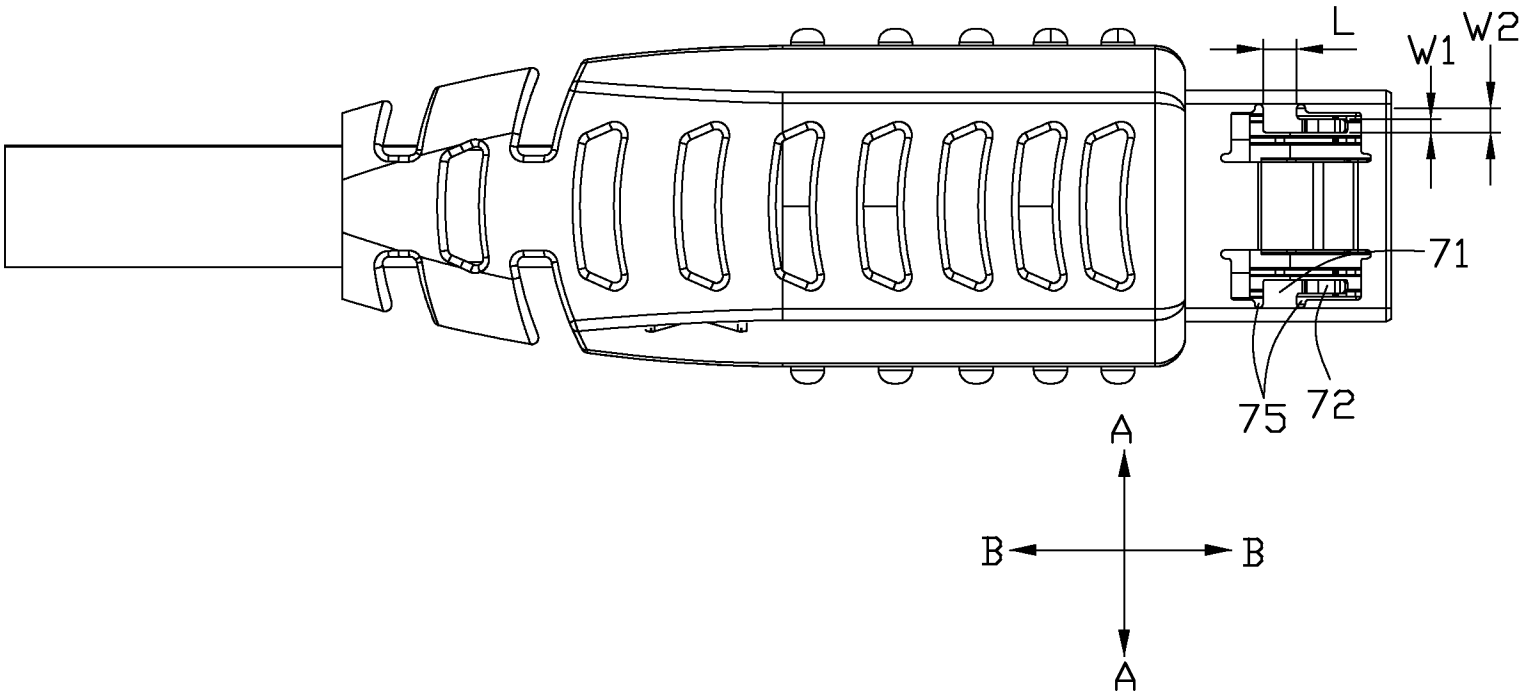
FIG. 7 is a top view of the plug connector as shown in FIG. 1.
Figure 8:
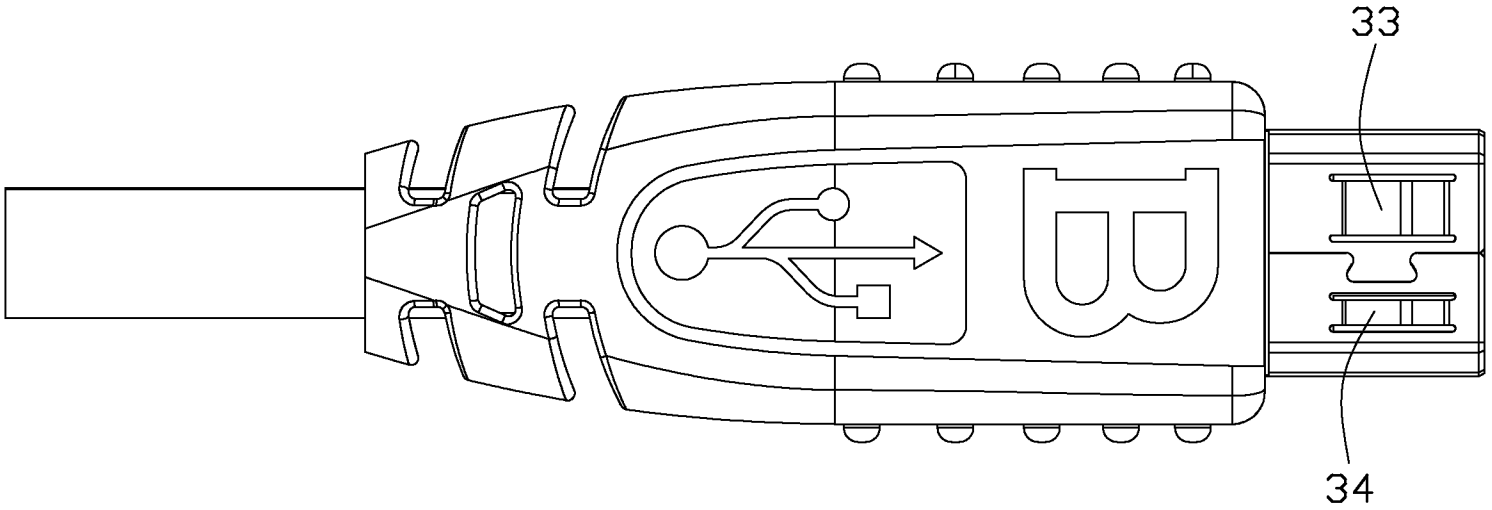
FIG. 8 is a bottom view of the plug connector as shown in FIG. 1.

Referring to FIGS. 5 to 8, the metal shell 3 includes a front tube portion 31 and an extension 32 extending upwardly and backwardly from the front tube portion 31. The extension 32 is higher than the front tube portion 31 to be in a step manner. The front tube portion 31 includes a top wall 311, a bottom wall 312, and a pair of side walls 313 connecting the top wall 311 and the bottom wall 312 to jointly form a receiving space 310 to accommodate the tongue portion 12 of the insulative housing 1. The top wall 311 includes a pair of receiving slots 74, a pair of L-shaped cantilevered arms 7 integrally formed with the top wall 311, and a first engaging arm 61 located between the pair of receiving slots 74. The pair of receiving slots 74 as well as the pair of L-shaped cantilevered or suspensive arms 7 are symmetrical with each other along a middle plane therebetween. Each receiving slot 74 includes a pair of slits 75 (as shown in FIG. 7) extending along a transverse direction A-A and a cutout 76 communicating with the slits 75. The cutouts 76 are located adjacent to the side walls 313. Each cantilevered arm 7 resides in the corresponding receiving slot 74 and further comprises a base portion 71 sidewardly protruding along the transverse direction A-A and a deformable arm 72 forwardly extending into the cutout 76 along a mating direction B-B perpendicular to the transverse direction A-A. The base portion 71 is coplanar with the top wall 311. Each cutout 76 does not extend through a front edge of the top wall 311 and the deformable arm 72 is terminated adjacent to the front edge. The base portion 71 is situated between the pair of slits 75 so that the base portion 71 is deformable along a vertical direction C-C perpendicular to the transverse direction A-A and the mating direction B-B.

Figure 11:
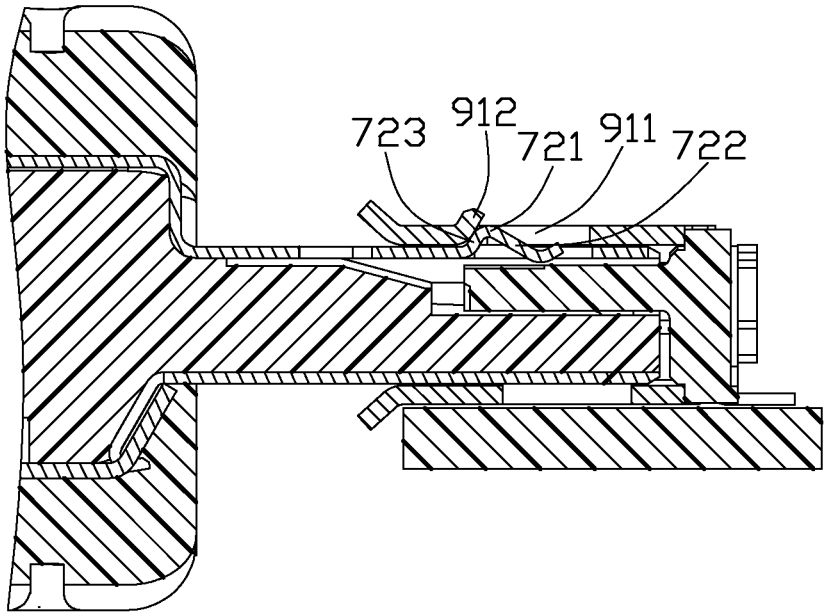
FIG. 11 is another cross-sectional view of the connector assembly taken along line 11-11 in FIG. 9 showing locking protrusions of the plug connector protruding into notches of the receptacle connector.

Referring to FIGS. 4 and 5, each cantilevered arm 7 is integrally stamped from the metal shell 3 for saving assembly costs and includes a locking protrusion 721 bent upwardly for locking with the notch 911 of the receptacle connector 200. As shown in FIG. 7, the base portion 71 has a length L measured along the mating direction B-B which is larger than a width W1 of the locking protrusion 721 measured along the transverse direction A-A. Besides, the base portion 71 has a width W2 measured along the transverse direction A-A which is larger than the width W1 of the locking protrusion 721 as well. As a result, the base portion 71 can provide assistant support for deformation of the deformable arm 72 even if the base portion 71 itself is configured in a cantilevered manner. In a word, a balance of both elasticity and rigidity of the cantilevered arm 7 is achieved. The locking protrusion 721 is offset from a horizontal centerline of the base portion 71 as viewed from the mating direction B-B. As shown in FIGS. 5 and 7, corresponding inner side edges of the deformable arm 72 and the base portion 71 are aligned along the mating direction B-B. Referring to FIG. 11, the locking protrusion 721 includes a first slant portion 722 and a second slant portion 723 opposing the first slant portion 722. A slope of the first slant portion 722 is smaller than that of the second slant portion 723 so that the first slat portion 722 is more suitable as a guiding surface for guiding insertion of the plug connector 100 into the receptacle connector 200, and the second slant portion 723 is more suitable as a locking surface for abutting against the receptacle connector 200.

Referring to FIG. 5, the first engaging arm 61 is in a simple supported beam manner and includes a pair of first fixed ends 611 and a first protrusion 612 located between the first fixed ends 611. The first protrusion 612 extends beyond the top surface of the top wall 31 for abutting against the top wall 91 of the receptacle connector 200 in order to increase friction force.

Referring to FIGS. 5 and 6, the bottom wall 312 includes a second engaging arm 33 and a third engaging arm 34 separated a distance along the transverse direction A-A with respect to the second engaging arm 33. The second engaging arm 33 and the third engaging arm 34 are both in simple supported beam manners similar to the first engaging arm 61. The second engaging arm 33 is offset from and narrower than the first engaging arm 61. The third engaging arm 34 is located under one of the deformable arms 72 and narrower than the second engaging arm 33. The second engaging arm 33 includes a pair of second fixed ends 331 and a second protrusion 332 located between the second fixed ends 331. The third engaging arm 34 includes a pair of third fixed ends 341 and a third protrusion 342 located between the third fixed ends 341. The second and the third protrusions 332, 342 both extend beyond a bottom surface of the bottom wall 312 for abutting against the bottom wall 92 of the receptacle connector 200 to increase friction force. The first engaging arm 61 is located between the second engaging arm 33 and the third engaging arm 34 as viewed from the vertical direction C-C so that multiple contact points along the transverse direction A-A can be provided.

Referring to FIGS. 9-11, when the plug connector 100 is inserted into the plug-receiving cavity 90 of the receptacle connector 200, the first slant portion 722 of each locking protrusion 721 is abutted against the metal shield 9 to press the deformable arm 72 so that the deformable arm deforms in the corresponding cutout 76. Accordingly, the base portion 71 of each cantilevered arm 7 is driven to be deformed between the pair of slits 75. After the first slant portion 722 overcomes the friction and reaches the notch 911, the cantilevered arm 7 releases its elasticity so that the second slant portion 723 locks with the notch 911. Under this condition, the tapered contacting sections 251 of the contacts 2 abut against the flat contacting portions 831 of the receptacle contacts 83. The first, the second and the third engaging arms 61, 33 and 34 press against inner surfaces of the metal shield 9 to keep the plug connector 100 reside in the receptacle connector 200.

When the plug connector 100 is removed from the plug-receiving cavity 90 of the receptacle connector 200, the second slant portion 723 of each locking protrusion 721 is abutted against the metal shield 9 to deform the cantilevered arm 7. The first, the second and the third engaging arms 61, 33 and 34 withdraw from the metal shield 9 ultimately. The L-shaped cantilevered arm 7 is capable of providing suitable flexibility and rigidity during inserting the plug connector 100 into the receptacle connector 200 or withdrawing the plug connector 100 from the receptacle connector 200.

Referring to FIGS. 12 to 16, a second plug connector 100' according to a second embodiment of the present invention is disclosed. The second plug connector 100' is similar to the plug connector 100 of the first embodiment except the cantilevered arms 7' formed on a top wall 311'.

Figure 12:
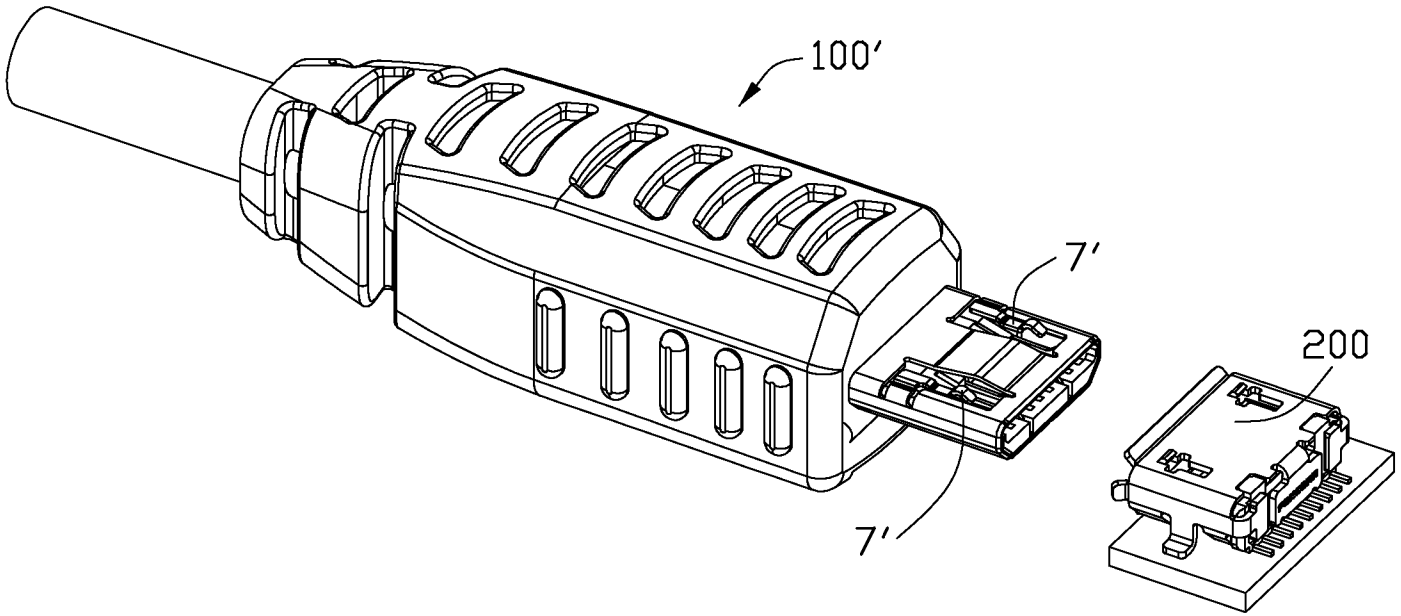
FIG. 12 is a perspective view of another connector assembly including the receptacle connector and a second plug connector prior to be inserted into the receptacle connector in accordance with a second embodiment of the present invention.
Figure 13:
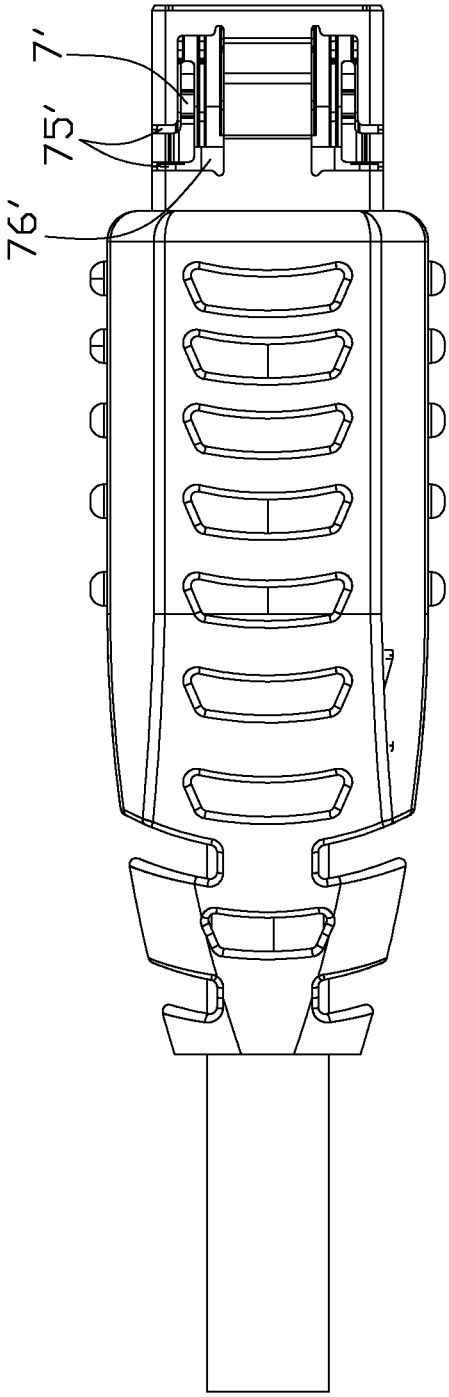
FIG. 13 is a top view of the second plug connector as shown in FIG. 12.
Figure 14:
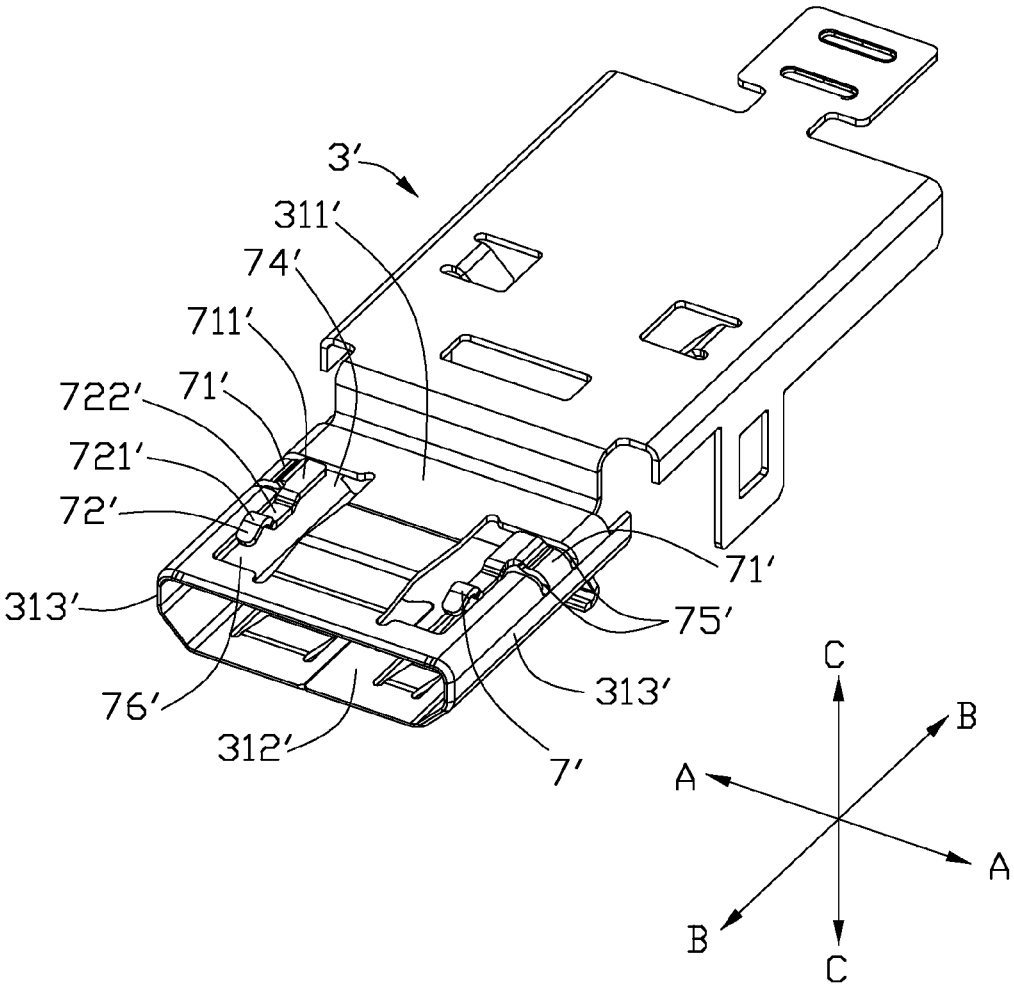
FIG. 14 is a perspective view of a metal shell of the second plug connector as shown in FIG. 12.
Figure 15:
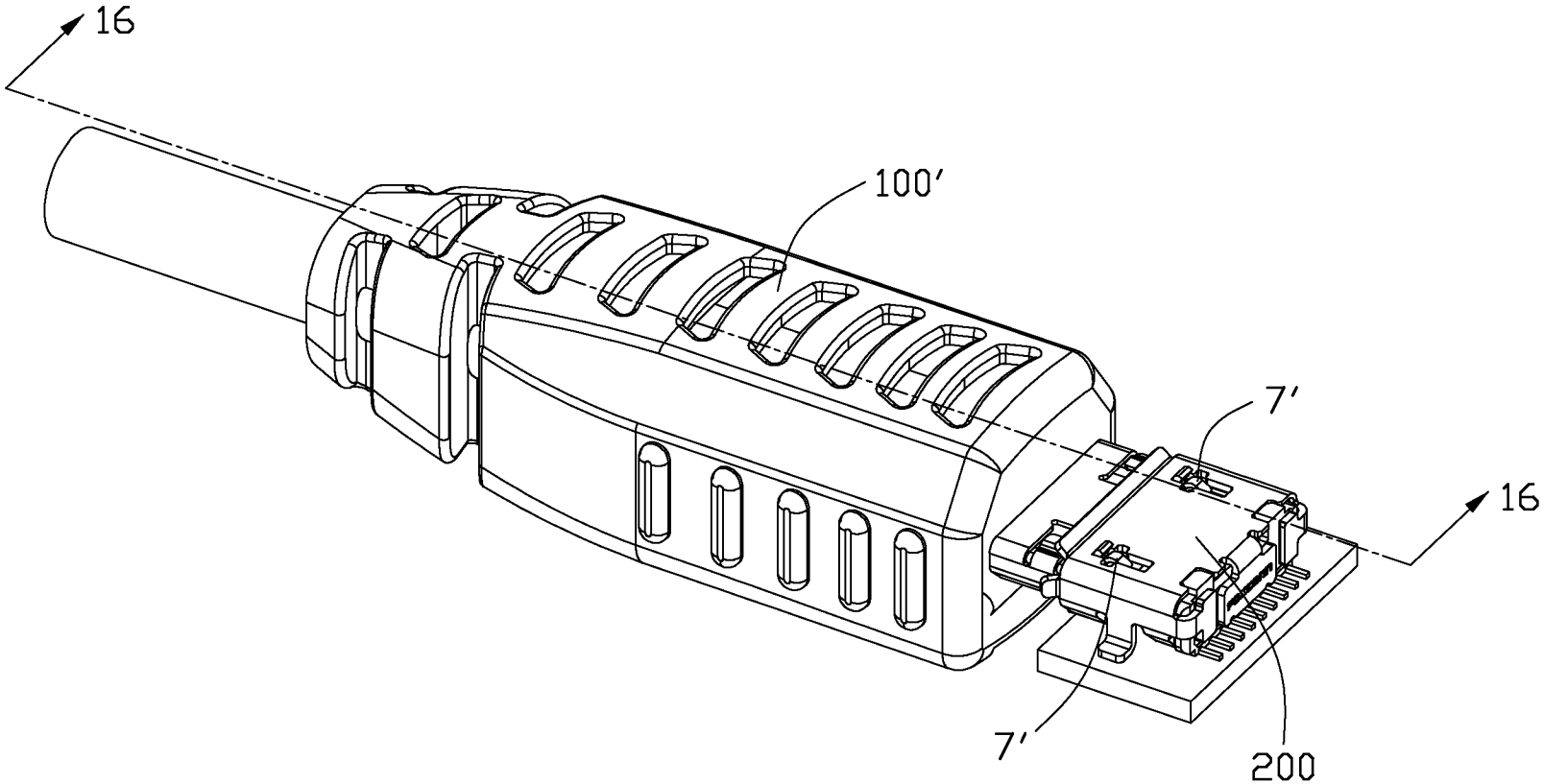
FIG. 15 is a perspective view of the connector assembly in accordance with the second embodiment showing the second plug connector inserted into the receptacle connector.
Figure 16:
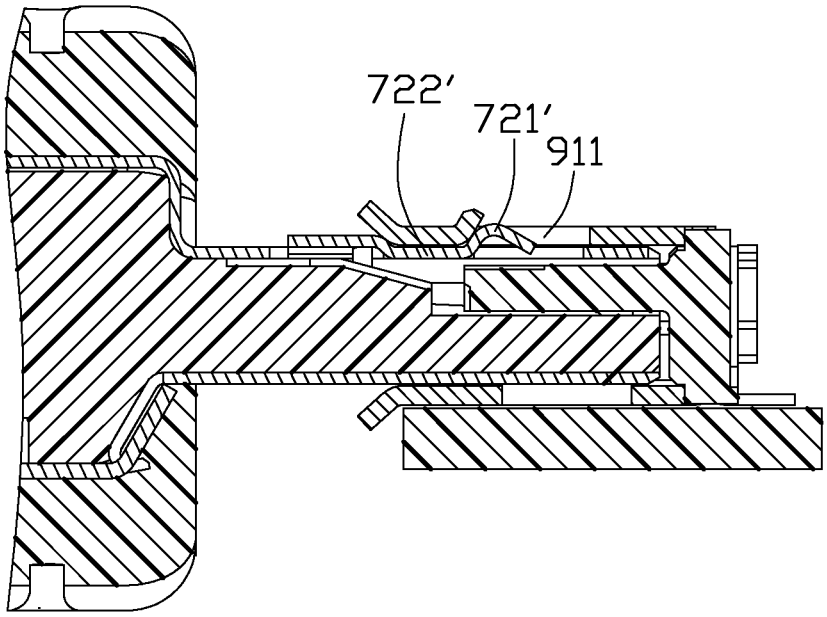
FIG. 16 is a cross-sectional view of the connector assembly taken along line 16-16 in FIG. 15 showing locking protrusions of the second plug connector protruding into notches of the receptacle connector.

Referring to FIGS. 12 and 14, the second plug connector 100' includes a metal shell 3' having the top wall 311', a bottom wall 312' and a pair of side walls 313' connecting the top wall 311' and the bottom wall 312'. The top wall 311' includes a pair of receiving slots 74', a pair of substantially L-shaped cantilevered arms 7' integrally formed with the top wall 311'. The pair of receiving slots 74' are the same as the receiving slots 74 of the first embodiment. Each receiving slot 74' includes a pair of slits 75' extending along the transverse direction A-A and a cutout 76' communicating with the slits 75'. Each cantilevered arm 7' resides in the corresponding receiving slot 74' and further comprises a base portion 71' sidewardly protruding along the transverse direction A-A and a deformable arm 72' forwardly extending into the cutout 76' along the mating direction B-B. The base portion 71' includes a protuberance 711' extending upwardly beyond the top wall 311'. The deformable arm 72' extends forwardly from the protuberance 711'. Besides, the deformable arm 72' includes a locking protrusion 721' and a depression 722' located between the locking protrusion 721' and the base portion 71'. The configuration of the locking protrusion 721' is the same as the locking protrusion 721 of the first embodiment so that detailed description thereof is omitted herein. Besides, as shown in FIG. 16, when the second plug connector 100' is fully inserted into the receptacle connector 200, the depression 722' is configured according with an inner structure of the receptacle connector 200 so as to restrict movement of the second plug connector 100' along the mating direction B-B. As a result, the second plug connector 100' can be kept in the receptacle connector 200.

Figure 17:
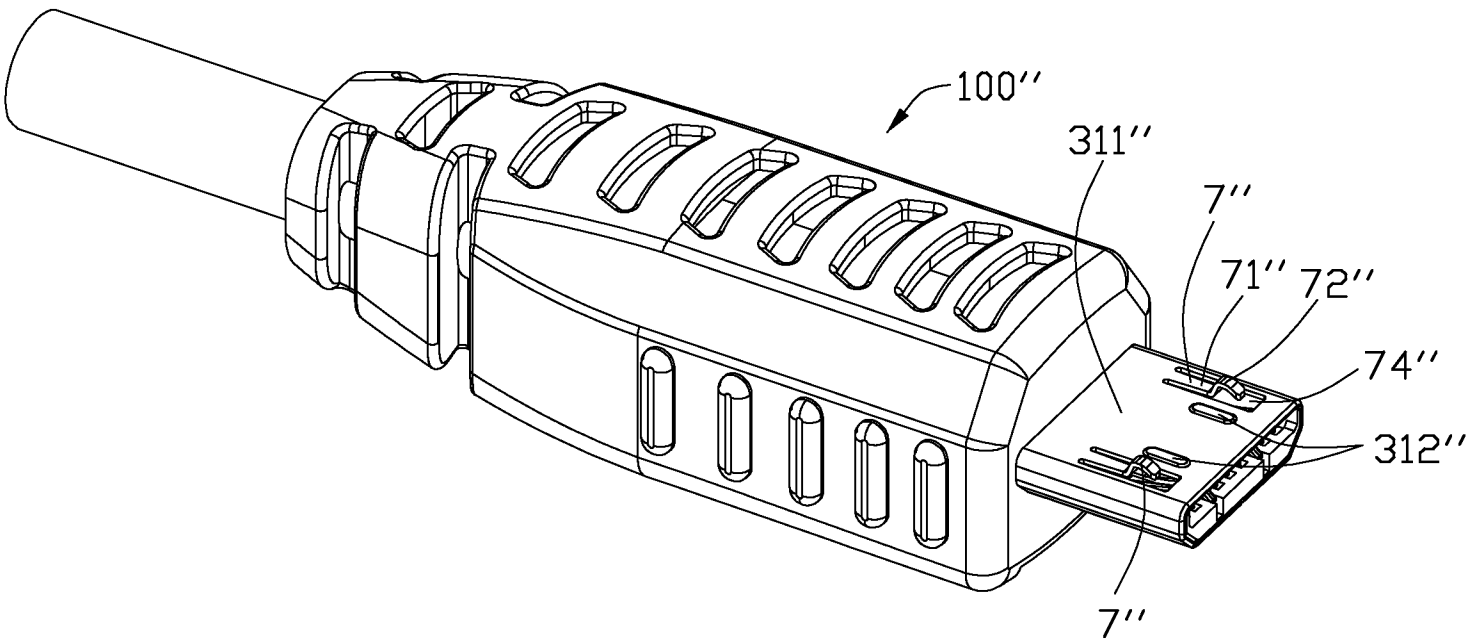
FIG. 17 is a perspective view of a third plug connector in accordance with a third embodiment of the present invention.
Figure 18:
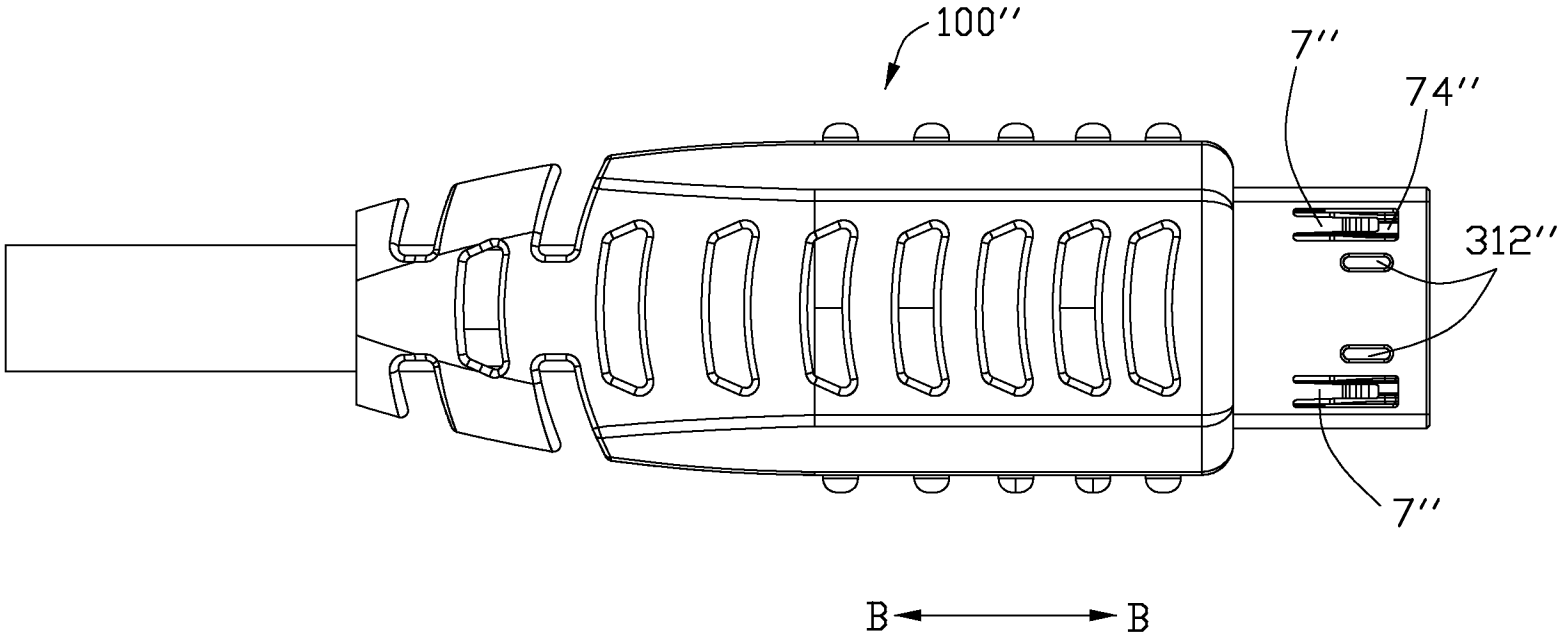
FIG. 18 is a top view of the third plug connector as shown in FIG. 17.

Referring to FIGS. 17 and 18, a third plug connector 100" according to a third embodiment of the present invention is disclosed. The third plug connector 100" is similar to the plug connector 100 of the first embodiment except the cantilevered arms 7" formed on a top wall 311".

Referring to FIG. 17, the third plug connector 100" includes a metal shell having the top wall 311" which further includes a pair of rectangular slots 74" and a pair of cantilevered arms 7" integrally formed with the top wall 311' and forwardly extending into the slots 74". Each cantilevered arm 7" includes a base portion 71" coplanar with the top wall 311" and a locking protrusion 72" formed on a distal end thereof. The locking protrusion 72" extends upwardly beyond the top wall 311" for deformably locking with the notch 911 of the receptacle connector 200. Each cantilevered arm 7" is gradually tapered along the mating direction B-B. The configuration of the locking protrusion 72" is the same as the locking protrusion 721 of the first embodiment so that detailed description thereof is omitted herein. In order to keep the third plug connector 100" stably inserted in the receptacle connector 200, the top wall 311" further includes a pair of ribs 312" extending upwardly for rubbing against inner sides of the metal shield 9.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing;

a plurality of contacts retained in the insulative housing; and a metal shell comprising a top wall, a bottom wall, and a pair of side walls connecting the top wall and the bottom wall to jointly form a receiving space to accommodate the insulative housing, the top wall comprising a pair of slits each extending along a transverse direction, a cutout communicating with the slits and a L-shaped cantilevered arm residing in the slits and the cutout, the cantilevered arm comprising a base portion sidewardly protruding from the side wall with a width along the transverse direction and situated between the pair of slits and a deformable arm extending in the cutout along a mating direction perpendicular to the transverse direction; wherein the deformable arm comprises a locking protrusion bent upwardly for locking with a notch of a mateable connector; and wherein said width of the base portion is greater than a width of the locking protrusion measured along the transverse direction.

2. The electrical connector as claimed in claim 1, wherein the cutout extends short of a front edge of the top wall and the deformable arm is terminated adjacent to the front edge.

3. The electrical connector as claimed in claim 1, wherein the locking protrusion is offset from an imaginary horizontal centerline of the base portion as viewed along the mating direction.

4. The electrical connector as claimed in claim 3, wherein a side edge of the deformable arm and a side edge of the base portion are aligned along the mating direction.

5. The electrical connector as claimed in claim 1, wherein the base portion comprises a protuberance extending upwardly beyond the top wall, the deformable arm extending from the protuberance.

6. The electrical connector as claimed in claim 5, wherein the deformable arm comprises a depression located between the locking protrusion and the base portion in order to restrict movement of the electrical connector along the mating direction when the electrical connector is mateable with the mateable connector.

7. The electrical connector as claimed in claim 1, wherein the top wall further comprises another cantilevered arm structured and arranged as a mirrored image to the cantilevered arm along an imaginary middle plane passing therethrough.

8. The electrical connector as claimed in claim 7, wherein the top wall comprises a first engaging arm configured in a simple supported beam manner and located between the cantilevered arm and the another cantilevered arm, the first engaging arm comprising a pair of first fixed ends and a first protrusion located between the first fixed ends, the first protrusion extending beyond outward for abutting against the mateable connector.

9. The electrical connector as claimed in claim 8, wherein the bottom wall comprises a second engaging arm and a third engaging arm each configured in a simple supported beam manner, the first engaging arm being located between the second engaging arm and the third engaging arm as viewed from a vertical direction.

10. The electrical connector as claimed in claim 9, wherein the second engaging arm and the third engaging arm comprise a second protrusion and a third protrusion, respectively, the second protrusion and the third protrusion extending beyond a bottom surface of the bottom wall for abutting against the mateable connector, the third engaging arm being narrower than the second engaging arm which is narrower than the first engaging arm.

11. The electrical connector as claimed in claim 1, wherein the contacts comprise five plug-type contacts and two pairs of contacts located on lateral sides of the five plug-type contacts, each contact comprising a tapered contacting section protruding into the receiving space and a mounting portion for being electrically connected with a cable.

12. An electrical connector assembly comprising:

a plug including a first insulative housing enclosed within a first metallic shell to commonly define therein a first mating port with a first mating face facing toward the first mating port, said first metallic shell defines opposite top and bottom walls wherein the top wall spaced from the first mating face via said mating port while the bottom wall abuts against a face of the housing which is opposite to the first mating face;

a plurality of first contacts disposed in the first housing with first contacting sections exposed upon the first mating face and toward the first mating port;

said top wall defining a pair of through openings, each of said openings defining a pair of lengthwise inner edges extending along a front-to-back direction, and a pair of transverse inner edges transversely linking said pair of lengthwise inner edges and extending along a transverse direction perpendicular to said front-to-back direction; and a cantilevered arm unitarily extending from one of said lengthwise inner edges and defining an angled configuration in a top view; wherein said cantilevered arm defines a base portion transversely extending from said one of the lengthwise inner edges and a deformable arm extending from said base portion forwardly with a locking protrusion bent upwardly for locking with a receptacle connector.

* * * * *